United States Patent [19]

Crossman

[11] Patent Number: 4,458,942

[45] Date of Patent: Jul. 10, 1984

[54] THREE-QUARTER FOLD RETRACTING CHAIR

[75] Inventor: Philip E. Crossman, Grand Rapids, Mich.

[73] Assignee: American Seating Company, Grand Rapids, Mich.

[21] Appl. No.: 328,122

[22] Filed: Dec. 7, 1981

[51] Int. Cl.[3] ..... A47C 1/02

[52] U.S. Cl. ..... 297/332; 297/331; 297/334; 297/335

[58] Field of Search ..... 297/331, 334, 332, 333, 297/335, 336

[56] References Cited

U.S. PATENT DOCUMENTS

| | | | |
|---|---|---|---|
| 2,250,223 | 7/1941 | Hard | 297/331 |
| 2,331,203 | 10/1943 | Lee | 297/331 |
| 2,439,370 | 4/1948 | Orton | 297/331 X |
| 2,509,739 | 5/1950 | McDonald | 297/331 |
| 2,530,625 | 11/1950 | Nordmark | 297/331 X |
| 3,493,263 | 2/1970 | Ré | 297/84 |
| 4,352,523 | 10/1982 | Holobauch, Jr. | 297/84 X |

*Primary Examiner*—James T. McCall
*Attorney, Agent, or Firm*—Emrich & Dithmar

[57] ABSTRACT

A chair of the type used in theaters or the like includes a seat mounted to a standard by pivot mechanisms which bias the seat to a three-quarter fold position in which the seat is raised to permit row egress. The chair back is pivotally mounted for rotation about a horizontal axis located in the back area of an occupant. A link connects the specially formed seat frame to the lower part of the back frame so that when the seat is in the three-quarter fold position, the top of the chair back is rotated forward so that the chair back assumes a generally vertical disposition thereby increasing egress room for the occupant of the row to the rear. Also, in the three-quarter fold position the link/frame mechanism locks the back panel in that position so that it cannot be displaced should an occupant of the next row to the rear grasp the back panel and use it to steady himself or pull himself out of his seat. When the seat is lowered for use, the link rotates the back panel to a normal inclined position for occupant comfort.

10 Claims, 5 Drawing Figures

FIG. 1
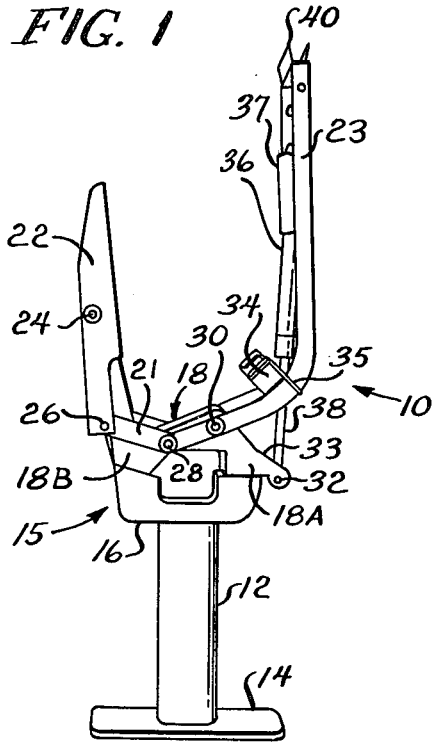
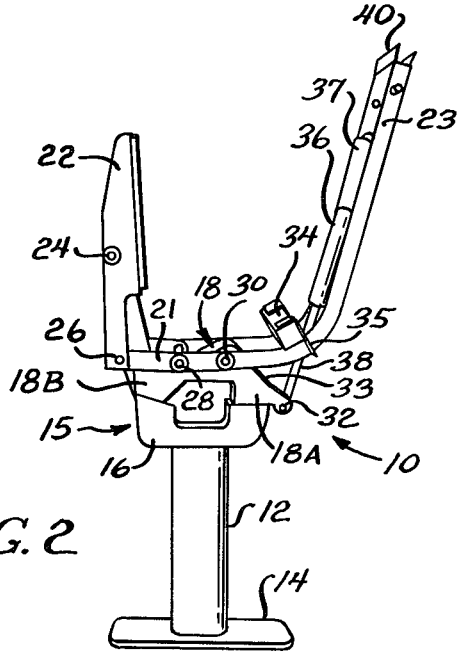
FIG. 2
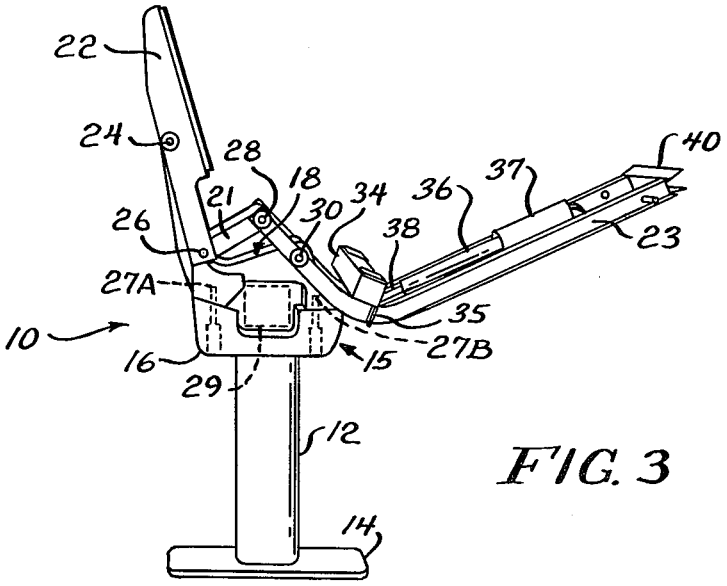
FIG. 3

THREE-QUARTER FOLD RETRACTING CHAIR

BACKGROUND OF THE INVENTION

This invention relates generally to folding chairs of the type as used in theaters and is particularly directed to an improved folding, retractable chair capable of assuming an intermediate three-quarter fold configuration for increasing passing space between adjacent rows of such chairs.

Folding, retractable chairs in which the seat portion swings upwardly to a generally vertical position and downwardly to a horizontal sitting position are widely used in a variety of spectator environments. The rotational displacement of the seat facilitates row egress and allows the seating area to be cleaned or swept more easily. Seats of this type sometimes include a third position, which is about a three-quarter fold raised position. The three-quarter fold raised position permits the occupant to more easily sit down without exerting a special effort in lowering the seat and also, when a full folding configuration is desired, the occupant can raise the seat to this full fold position simply by leaning against it. Then, as he steps forward to sit down, the seat instantly assumes the three-quarter fold position so that no effort is required in moving the seat to the sitting position.

In addition, some folding, retractable chairs have the capability of moving the back to a generally vertical position when the seat is retracted. This further increases passing space between adjacent rows of seats with the attendant aforementioned advantages similarly enhanced.

The present invention provides a three-quarter fold retracting chair which requires less parts and expense to produce, is of simpler design, and is more reliable than prior art folding retractable chairs. The chair disclosed and claimed herein also facilitates row passage and egress by providing an essentially vertical orientation of the chair's back in the fully retracted and the three-quarter fold positions. In addition, the present invention provides a stable, upright back when the seat is in the three-quarter fold position allowing a person sitting in the next row to the rear to grasp the back portion of the seat in front for the purpose of steadying or pulling himself out of his chair.

SUMMARY OF THE INVENTION

The present invention includes a standard to which are pivotally mounted the seat and back elements of a folding chair. Linkage pivotally couples the seat and the back elements such that with the seat in the retracted or folded position, the chair back assumes a generally vertical disposition. This increases row egress space. Similarly, with the seat in the extended or occupied position, the back is positioned in a normal inclined orientation for occupant comfort. This linkage also allows the chair to assume a three-quarter fold raised position from which the chair may be re-positioned to the retracted or extended configuration with equal ease. In the three-quarter fold position the connecting linkage assumes an over-center locked configuration for locking the chair back in a generally vertical position. This permits the chair back to be grasped by an occupant of the next row to the rear for steadying himself or pulling himself out of his chair. Incorporated in the seat element of the chair is a biasing means, such as a spring-loaded piston, coupled to the chair standard for urging the seat element to the three-quarter fold raised position and for urging the back element to a generally vertical disposition by means of the linkage therebetween when the chair is unoccupied. A combination rigid pan and cushion assembly is affixed to the seat and back elements of the chair for occupant comfort and safety and aesthetic purposes.

BRIEF DESCRIPTION OF THE DRAWINGS

The appended claims set forth those novel features believed characteristic of the invention. However, the invention itself as well as further objects and advantages thereof will best be understood by reference to the following detailed description of a preferred embodiment taken in conjunction with the accompanying drawings, where like reference characters identify like elements in the several figures, in which:

FIG. 1 is a perspective view of the three-quarter fold retracting chair of the present invention in the retracted position so that the row is cleared for ease in egress;

FIG. 2 is a perspective view of the retracting chair of the present invention in the three-quarter fold position;

FIG. 3 is a perspective view of the three-quarter fold retracting chair in the extended or occupied position;

DESCRIPTION OF THE PREFERRED EMBODIMENTS

Figure 4:
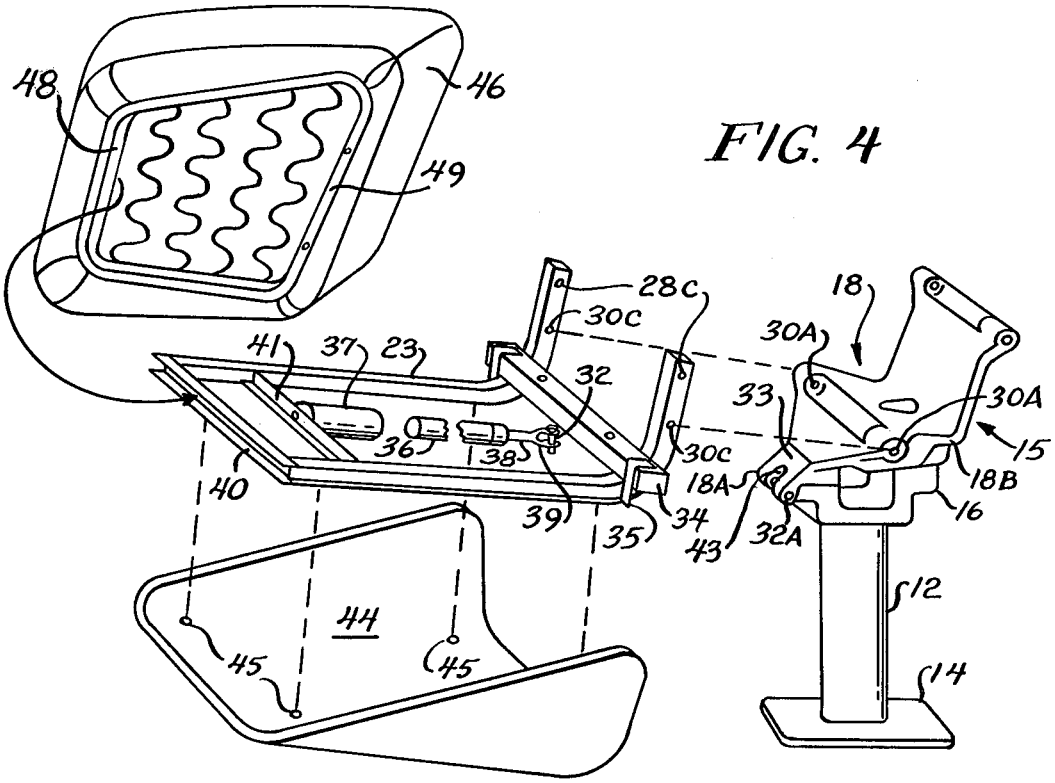
FIG. 4 is an exploded view of the seat portion of the retracting chair together with the chair support mounted on the chair's standard.

Referring to FIGS. 1, 2 and 3, there is shown a three-quarter fold retracting chair 10 in accordance with the present invention. The retracting chair includes a standard 12, the bottom portion of which is rigidly coupled to a mounting base 14. Mounting base 14 may be adapted to be securely mounted by conventional means, such as bolts, to the floor of a spectator viewing area. Rigidly coupled to an upper portion of standard 12 is chair support 15. Chair support 15 includes a lower support member 16 and an upper support member 18. Chair support 15 may be cast from a single piece of metal or may include two separately cast members, such as lower and upper support members 16, 18 which are securely coupled such as by bolting these elements together.

While lower support member 16 is rigidly mounted on standard 12, upper support member 18 is pivotally coupled to the back element 22 and the seat element 23 of the retracting chair to permit the free, coordinated movement of these chair elements thereupon. Upper support member 18 includes a front portion 18A and a rear portion 18B. The front portion 18A of upper support member 18 is pivotally coupled to seat element 23 along the axis defined by connecting pin 30. Similarly, its rear portion 18B is pivotally coupled to the chair back along the axis defined by connecting pin 24. Upper support member 18, back element 22 and seat element 23 thus include a plurality of aligned apertures therein into which connecting pins 24 and 30 are inserted for pivotally coupling the back and seat elements 22, 23 of the chair respectively to the upper support member 18. These aligned configurations of mounting apertures are described in greater detail below with respect to the exploded views of FIGS. 4 and 5. Once positioned in these mounting apertures, the connecting pins are maintained there by conventional means such as by lock nuts or end caps.

In a third set of apertures located in the front portion 18A of upper support member 18 is inserted connecting pin 32 to which is pivotally coupled the distal end of the piston rod 38 of piston 36. The details regarding the coupling between piston rod 38 and connecting pin 32 and the operation of piston 36 are described in detail below.

The back and seat elements 22, 23 of the chair are pivotally coupled together by means of linkage 21. Connecting pins 26, 28 are inserted through apertures in the lower end portion of chair back element 22 and the rear portion of seat element 23, respectively, and through apertures in respective ends of linkage 21. Linkage 21 actually includes two separate elements positioned on each side of the chair which are cooperatively coupled to adjacent, corresponding side elements of back element 22 and seat element 23. By thus providing a mechanical linkage between back element 22 and seat element 23, the positioning and orientation of these elements are interdependent and cooperative in nature. Thus, with the chair in the fully retracted position, as shown in FIG. 1, seat element 23 is oriented in a generally vertical direction while displacing the lower portion of back element 22 away from standard 12 so as to also position back element 22 in a generally vertical orientation. Referring to FIG. 2, with seat element 23 in the three-quarter fold position, back element 22, which is free to pivot about connecting pin 24, is still maintained in a generally vertical orientation due to the spacing provided by linkage 21 between the lower portion of back element 22 and the rear portion of seat element 23. Similarly, in FIG. 3 it can be seen that the lowering of seat element 23 to the extended position causes the lower portion of back element 22 to be pulled forward by means of linkage 21 and that portion of seat element 23 to which it is coupled. With the bottom portion of back element 22 thus displaced, back element 22 is oriented in a generally inclined, or non-vertical, position when seat element 23 is in the extended, or generally horizontal, position for occupant comfort.

Referring back to FIG. 2, it can be seen that with seat element 23 in the three-quarter raised position that portion of seat element 23 which is pivotally coupled to upper support member 18 and proximally located with respect to back element 22 is aligned with linkage 21. Linkage 21 is simultaneously oriented at essentially a 90° angle with back element 22. Thus, the linear configuration of linkage 21 and that portion of seat element 23 which is pivotally coupled to upper support member 18 form an over-center rigid structural configuration for locking back element 22 in a near vertical orientation. Back element 22 may only be moved from this position by first displacing seat element 23 either upward or downward so as to remove the over-center locking arrangement. With the retractable, folding chair in the three-quarter fold position as shown in FIG. 2, back element 22 may thus be grasped and used as a rigid support by one standing or moving in the row to the rear of retracting chair 10 or may be grasped by one positioned in the seat immediately to the rear of retracting seat 10 as an aid in pulling himself out of his chair.

Attached to seat element 23 is cylinder mounting bracket 37 which is in cooperative alignment with cylinder 36. Cylinder 36 includes a movable piston (not shown) therein and a telescoping piston rod 38 having a distal end with respect to cylinder 36 which is pivotally coupled by means of connecting pin 32 to the front portion 18A of upper support member 18. With cylinder mounting bracket 37 fixedly mounted to seat element 23 and with piston rod 38 pivotally coupled to upper support member 18, cylinder 36 exerts a displacing force therebetween so as to bias seat element 23 to the three-quarter fold position. This allows the folding seat to automatically revert to a raised position when unoccupied. Cylinder 36 may be any conventional movement biasing means such as a spring-loaded cylinder or a single-acting gas cylinder.

In a preferred embodiment of the present invention, cylinder 36 includes a spring-loaded piston and is sized so as to snugly yet easily fit within cylinder mounting bracket 37. Seat element 23 further includes a structural support bar 34 coupled thereto by means of mounting brackets 35 located on each end of structural support bar 34. Structural support bar 34 reinforces seat element 23 and increases the strength of the chair at a critical location. In addition, structural support bar 34 acts as a displacement stop in limiting the downward pivotal displacement of seat element 23 by contacting an upper surface 33, as shown in FIGS. 1 and 2, of chair support 15. With seat and back elements 23, 22 mechanically linked as previously described, support bar 34 also is a displacement stop for back element 22 in limiting its inclined orientation as shown in FIG. 3 where support bar 34 is depicted as in contact with the stop surface (not shown) of chair support 15. Seat element 23 includes a seat cushion mounting lip 40 positioned on the distal end thereof for facilitating the mounting of a seat cushion thereon as explained in greater detail below.

Referring to FIG. 4, there is shown an exploded perspective view of the seat portion of the retracting chair together with chair support 15 to which it is pivotally coupled, with chair support 15 mounted upon standard 12 and mounting base 14. Seat element 23 includes a cross bracket 41 for reinforcing the structure thereof and for providing a rigid support for cylinder guide 37 to which it is securely mounted. To the upper portion of seat element 23 is mounted a seat cushion 46 by means of seat cushion mounting lip 40 on the forward edge thereof. Seat cushion 46 is positioned so that cushion forward frame member 48 is slidably engaged by seat cushion mounting lip 40. Conventional connecting pins may be inserted through holes in rear frame member 49 and structural support bar 34 for fastening seat cushion 46 to seat element 23. Seat cushion 46 is thus firmly attached to the upper portion of seat element 23 in providing a comfortable seating surface for an occupant thereof. Seat pan 44 is firmly affixed to the bottom portion of seat element 23 by means of a plurality of connecting pins (not shown), such as conventional threaded screws, inserted through a plurality of apertures 45 in seat pan 44. The connecting pins are then inserted in corresponding apertures (not shown) in seat element 23 and the frame of seat cushion 46 and securely affixed thereto. Conventional coupling means are envisioned for use in this portion of the present invention with hidden fasteners of conventional design used for mounting and positioning seat and back pans 44, 50 in a preferred embodiment. Such hidden fasteners are secrued to an internal, rigid portion of a seat pan and are not visible externally once the chair is assembled. Seat pan 44 thus provides a safe and aesthetically appealing lower surface for the seat portion of the chair while providing protection for the internal elements of seat cushion 46 and seat element 23, particularly in the raised position.

The distal portion of piston rod 38 is pivotally coupled to the front portion 18A of support member 18 by means of a connecting pin 32 inserted through a hole in the end of piston rod 38. Connecting pin 32 is similarly inserted through apertures 32A in the forward portion of upper support member 18 and secured therein by conventional means allowing piston rod 38 to pivot within slot 43 in the front portion 18A of upper support member 18. As previously described, a connecting pin 30 is inserted through apertures 30C in the rear portion of seat element 23 when apertures 30C are in alignment with apertures 30A in upper support member 18. It is along the axis defined by apertures 30A in upper support member 18 that seat element 23 pivots with respect to chair support 15. Connecting pins are also inserted through apertures 28C in seat element 23 when they are aligned with the apertures in one end portion of linkage 21 (not shown) to form a pivotal connection therebetween.

Figure 5:
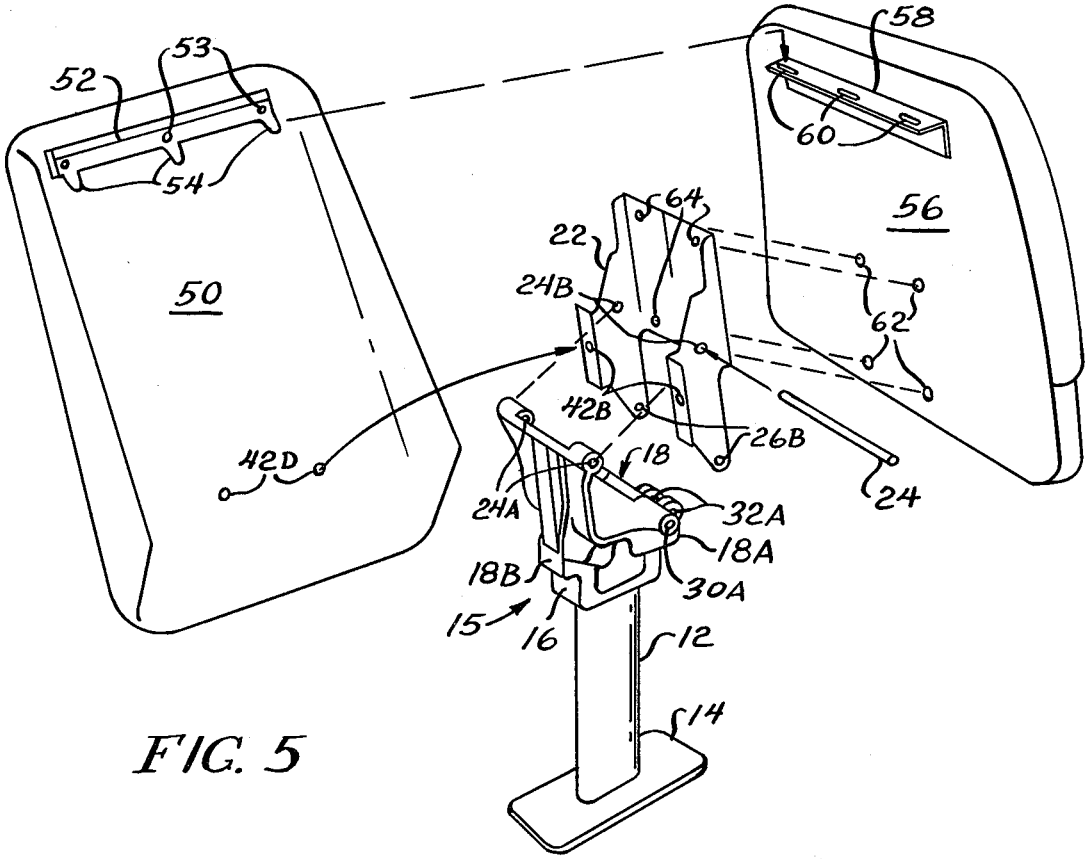
FIG. 5 is an exploded view of the chair's back portion and the chair support mounted on the standard of the retracting chair.

Referring to FIG. 5, there is shown an exploded view of back element 22 to which are mounted back pan 50 and back cushion 56 and which is pivotally mounted on chair support 15. Back pan 50 includes apertures 42D on a lower portion thereof through which connecting pins (not shown) may be inserted and fastened to back element 22 by insertion also through apertures 42B therein. Again, hidden fasteners of conventional design which are secured to an internal portion of back pan 50 are utilized here in a preferred embodiment. Back pan 50 may be thus rigidly mounted on back element 22. To an upper portion of the front surface of back pan 50 is mounted an attachment bracket 52 which includes a plurality of bracket extensions 54 projecting downward from bracket 52 and displaced forwardly from back pan 50. Attachment bracket 52 is fixedly coupled to back pan 50 by conventional means such as threaded screws or connecting pins 53.

Back cushion 56 is secured to the forward surface of back element 22 by means of connecting pins (not shown) inserted through corresponding apertures 62 in back cushion 56 and apertures 64 in back element 22. These connecting pins may be positioned and secured in the respective apertures in back cushion 56 and back element 22 by conventional means. On an upper portion of the rear surface of back cushion 56 is mounted a cushion mounting bracket 58. Cushion mounting bracket 58 includes a plurality of apertures 60 positioned on a surface thereof extending away from back cushion 56. In assembling the back portion of the chair, with back cushion 56 securely mounted on back element 22, the bracket extensions 54 of attachment bracket 52 located on a forward surface of back pan 50 are inserted through apertures 60 of cushion mounting bracket 58. Back pan 50 may then be mounted to back element 22 by inserting appropriate connecting pins through apertures 42D and 42B or by affixing hidden fasteners to an internal portion of back pan 50 and securely fastening whichever coupling means are used. It is in this manner that the back portion of the retracting chair is assembled.

For additional explanatory detail, the coupling between back element 22 and chair support 15 will now be described with respect to FIG. 5. With the apertures 24A on chair support 15 and the apertures 24B on back element 22 aligned, connecting pin 24 is inserted through these aligned apertures allowing back element 22 and, of course, back pan 50 and back cushion 56 when mounted thereto, to pivot with respect to chair support 15. The pivoting force is applied to back element 22 at a lower portion thereof by means of connecting pins (not shown) inserted through apertures 26B. These same connecting pins are also inserted through apertures in one end of the linkage (not shown) which connects the lower portion of back element 22 to seat element 23, as previously described.

Referring back to FIG. 3, there is shown another embodiment of chair support 15. Rather than being formed as a single unit either as a unitary casting or by welding upper and lower support members 18, 16 together, chair support 15 may be formed by coupling two separate elements together such as by bolting or clamping as shown in FIG. 3. Shown therein in dotted line form are two clamping screws 27A, 27B rigidly coupling lower and upper support members 16, 18. This permits the chair of the present invention to be easily fitted on and securely fastened to a horizontal support which is shown in dotted line form in FIG. 3 as element 29 and is positioned in the aperture between lower and upper support members 16, 18. Arm rests (not shown) may then be mounted on horizontal support bar 29 on both sides of retracting chair 10 in a conventional manner. Similarly, retracting chair 10 may be mounted on standard 12 with a short horizontal beam 29 inserted in the aperture of chair support 15 for mounting arm rests thereupon.

While particular embodiments of the present invention have been shown and described, it will be apparent to those skilled in the art that changes and modifications may be made therein without departing from the invention in its broader aspects. The aim of the appended claims, therefore, is to cover all such changes and modifications as fall within the true spirit and scope of the invention.

I claim:

1. A retracting chair comprising a standard; a seat pivotally mounted on said standard; a back pivotally mounted on said standard; biasing means coupled between said standard and said seat for urging said seat to a retracted position when said chair is unoccupied; and linkage pivotally coupling said seat and said back wherein said linkage assumes a first position with said seat retracted in urging said back to a generally vertical disposition, a second position with said seat in an extended use position in urging said back to an inclined disposition, and a third, locked position intermediate between said first and second positions with said seat in a three-quarter raised position in urging said back to a fixed, generally vertical disposition wherein further pivotal movement of said back is restrained by said linkage.

2. The chair of claim 1 wherein said biasing means includes a spring-loaded piston having a linear displaceable piston rod pivotally coupled to said standard.

3. The chair of claim 1 wherein said biasing means includes a single-acting gas piston coupled between said standard and said seat for urging said seat to a retracted position when said chair is unoccupied.

4. The chair of claim 1 further comprising chair support means for pivotally coupling said seat and back to said standard.

5. The chair of claim 4 wherein said chair support means includes an upper member and a lower member, wherein said lower member is rigidly coupled to said standard and said seat and said back are pivotally coupled to said upper member.

6. The chair of claim 5 wherein said seat includes rotation stop means fixedly mounted thereon for contacting the upper member of said chair support means when said seat is moved to said extended use position in stopping further downward displacement of said seat.

7. The chair of claim 5 wherein an aperture is provided between the upper and lower members of said chair support means with said standard inserted in said aperture for supporting said chair and wherein said standard is generally horizontally oriented and said upper and lower members are tightly coupled thereabout.

8. The chair of claim 1 wherein said seat and back each include a cushion on the respective upper and front surfaces thereof and a rigid back panel in facing relation thereto on the respective lower and rear surfaces thereof.

9. In a folding, retractable chair mounted on a rigid support member and including a seat and a back pivotally coupled to said rigid support member, a system for coupling said seat and back in controlling the coordinated movement thereof between a first extended position and a second retracted position wherein said seat is displaced from a generally horizontal to a generally vertical orientation and said back is displaced from an inclined to a generally vertical orientation, and including biasing means for yieldably urging said seat into a three-quarter raised position therebetween, said system comprising: a rigid structural member; first connecting means for pivotally coupling a first end portion of said structural member to a lower portion of said back; and second connecting means for pivotally coupling a second end portion of said structural member to a proximal portion of said seat adjacent said rigid support member whereby said structural member may be freely displaced between first and second opposed off-center positions relative to the proximal portion of said seat corresponding respectively to the extended and retracted positions of said chair and including an intermediate position therebetween wherein said structural member is aligned with the proximal portion of said seat in establishing an over-center stable configuration therebetween wherein said back is locked in position.

10. A folding, retractable chair comprising: a support structure; a back having upper and lower portions and an intermediate portion therebetween whereat said back is pivotally coupled to said support structure and movable between an inclined and a generally vertical position; and a seat having a rear portion pivotally coupled to the lower portion of said back, a front portion movable between an upper, retracted position and a lower, extended position and an intermediate portion therebetween pivotally coupled to said support structure, wherein the lower portion of said back is displaced horizontally causing said back to pivot about the intermediate portion thereof in response to the pivotal vertical displacement of the front portion of said seat and wherein the coupling between the lower portion of said back and the rear portion of said seat is characterized in that said back is rigidly secured in said generally vertical position when said seat is in said intermediate position.

* * * * *